US010622138B2

(12) United States Patent
De Santis, Jr. et al.

(10) Patent No.: US 10,622,138 B2
(45) Date of Patent: Apr. 14, 2020

(54) COOLING DUCTS FOR TRANSFORMERS' WINDING

(71) Applicant: SIEMENS AKTIENGESELLSCHAFT, Munich (DE)

(72) Inventors: Eugenio De Santis, Jr., Jundiai-Sao Paulo (BR); Joel Mendes, Famoes-Odivelas (PT); Antonio Pedro Silva, Sintra (PT); Stephan Voss, Neunkirchen am Brand (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/525,845

(22) PCT Filed: Oct. 28, 2015

(86) PCT No.: PCT/EP2015/074984
§ 371 (c)(1),
(2) Date: May 10, 2017

(87) PCT Pub. No.: WO2016/074928
PCT Pub. Date: May 19, 2016

(65) Prior Publication Data

US 2017/0323719 A1 Nov. 9, 2017

(30) Foreign Application Priority Data

Nov. 10, 2014 (EP) ..... 14192497

(51) Int. Cl.
*H01F 27/30* (2006.01)
*H01F 27/28* (2006.01)
(Continued)

(52) U.S. Cl.
CPC ..... *H01F 27/2876* (2013.01); *H01F 27/025* (2013.01); *H01F 27/322* (2013.01); *H01F 27/425* (2013.01)

(58) Field of Classification Search
CPC .. H01F 27/2876; H01F 27/322; H01F 27/025; H01F 27/425; H01F 27/085;
(Continued)

(56) References Cited

U.S. PATENT DOCUMENTS 2,313,306 A 3/1943 Wiegand
2,544,845 A * 3/1951 Link ..... H01F 27/2876 336/184
(Continued)

FOREIGN PATENT DOCUMENTS

DE 102011080827 A1 2/2013
JP S5015066 B1 6/1975
(Continued)

*Primary Examiner* — Mang Tin Bik Lian
(74) *Attorney, Agent, or Firm* — Laurence Greenberg; Werner Stemer; Ralph Locher

(57) ABSTRACT

A winding arrangement for an electric installation has an electric conductor and a plurality of cooling ducts. The electric conductor is coiled up forming several layers around an axis. Each cooling duct extends between a pair of adjacent layers of the coiled electric conductor in axial direction through the winding arrangement and in tangential direction not entirely around the axis. The cooling ducts of the plurality of cooling ducts are distributed among more than one pair of adjacent layers such that the winding arrangement is substantially cylindrical.

11 Claims, 10 Drawing Sheets

(51) Int. Cl.
*H01F 27/32* (2006.01)
*H01F 27/02* (2006.01)
*H01F 27/42* (2006.01)

(58) Field of Classification Search
CPC .... H01F 27/328; H01F 41/005; H01F 41/063; H01F 41/066; H01F 41/068
USPC ..... 336/60, 199, 206, 207; 29/602.1, 605, 29/606
See application file for complete search history.

(56) References Cited

U.S. PATENT DOCUMENTS

| | | | | |
|---|---|---|---|---|
| 7,647,692 | B2 | 1/2010 | Lanoue et al. | |
| 2013/0321113 | A1* | 12/2013 | Roy | H01F 27/288 336/60 |

FOREIGN PATENT DOCUMENTS

| | | | |
|---|---|---|---|
| JP | H08316052 | A | 11/1996 |
| JP | 09199344 | A | 7/1997 |

* cited by examiner

COOLING DUCTS FOR TRANSFORMERS' WINDING

BACKGROUND OF THE INVENTION

Field of the Invention

The invention relates to the technical field of winding arrangements for electric installations.

An electrical transformer is equipment used in an electric grid of a power system. Electrical transformers are responsible to transform the voltage and current in order to transport and distribute electric energy.

Due to the Joule effect and additional losses produced by Foucault currents the conductor material heats up. Consequently it is necessary to cool those materials down in order to maintain an admissible temperature, and in order to prevent the insulation ageing phenomena. For instance the average temperature allowed for a class A insulation material is 105° C. Therefore it is crucial to design the whole transformer to fit the maximum temperature allowable.

At the low voltage (LV) side of large electrical transformers usually a foil winding type is used as a conductor material. The usage of this kind of winding type brings advantages, essentially on robustness, due to the prevention of axial forces caused by the external short circuit on the active part of the transformer. The electric current adjusts itself along the foil winding to compensate imbalances of the geometric and magnetic fields between the high voltage (HV) part and LV part of the transformer. Moreover foil windings can be usually produced in a fast and simple production process.

The inner cooling is achieved by an internal cooling duct displaced circumferentially and composed by strips for mechanical consistency and robustness of the winding. The total channels are positioned, normally, between several layers of conductor and insulation material, where the oil contacts with only one entire turn, or portion of a turn when partial channel is used.

The number of cooling channels is related to the amount of energy that is necessary to release from the winding, and can combine several concentric cooling channels on radial direction, but separately. The limit is the radial dimension of the windings and this is directly related to entire design of the machine and proportionally to the costs.

DE 10 2011 080 827 A1 discloses a proposal for the position and geometry of the cooling ducts and symmetric symmetry Ducts arrangement on opposite sides.

JPH09199344 (A) describes an undulate strip for cooling channel that contributes to an entire piece and easy to assemble, however is not a conductor material and is located between one pair of turns.

JPH08316052 (A) discloses a foil winding transformer that envisages several holes to allow a cooling fluid to circulate on circumferential direction.

The typical design of electric transformers for energy distribution according to the state of the art is based on wired and foil winding types and composed by axial cooling channels. FIG. 1A shows a state of the art wired winding arrangement, while FIG. 1B shows a state of the art winding arrangement that is based on a coiled foil. For power transformers it is usual to have layer or disc type winding.

During the winding process a serial of strips is positioned around one ordinary turn and then more on subsequent turns if it is required with regard to the required cooling and temperature.

FIG. 2A shows a component 200 for an electrical transformer according the state of the art. The component 200 comprises an inner winding arrangement 210 and an outer winding arrangement 220 arranged around the inner winding arrangement 210. The inner winding arrangement 210 is made of insulated conductive foil for the LV part of the transformer. The outer winding arrangement 220 is made of enameled wire for the HV part of the distribution transformer. The inner winding arrangement 210 and the outer winding arrangement 220 form together an overall winding arrangement. The component 200 comprises several cooling channels in axial direction. During operation of the electrical transformer, the cooling channels are usually flowed through by a cooling oil. The cooling channel 230 that is located between the inner winding arrangement 210 and the outer winding arrangement 220 is usually called stray channel The inner winding arrangement 210 and the outer winding arrangement 220 both comprise themselves further circumferential cooling ducts 211-213, 221-223. Between each pair of adjacent circumferential cooling ducts 211-213, 221-223 more than one layer of windings is arranged, as can be best seen in FIG. 2B which is an enlarged view of the inner winding 210 made of conductive foil. Therefore, some layers of the electric conductor are closer to the cooling ducts than other. This is a drawback since heat from these layers has to travel a longer way to be dissipated. Moreover, as can be observed without effort, the volume of cooling ducts is almost the same as the volume of the conductor material.

As can also be seen best in FIG. 2B, the circumferential cooling ducts 211-213 are stabilized by strips 215-218 that extend in axial direction along the circumferential ducts 211, 212.

The usage of each cooling channel increases the radial dimension. To avoid the overheating and minimize damage of the transformer, usually a large coefficient of safety for electrical density is used. For example, the cross section of the conductors is increased. Also special insulation material such as Nomex® is applied when the maximum temperature is expected to exceed the value for class A materials.

SUMMARY OF THE INVENTION

However, there is still a need for winding arrangements with improved heat dissipation and reduced construction size. It is the object of the present invention to reduce the size of a winding arrangement and to improve heat dissipation.

This objective is solved by the measures taken in accordance with the independent claims. Further advantageous embodiments are proposed by the independent claims.

According to an aspect a winding arrangement for an electric installation is proposed. The winding arrangement comprises an electric conductor and a plurality of cooling ducts. The electric conductor is coiled up forming several layers around an axis. Each cooling duct of said plurality of cooling ducts extends between a pair of adjacent layers of the coiled electric conductor in axial direction through the winding arrangement and in tangential direction not entirely around the axis. The cooling ducts of the plurality of cooling ducts are distributed between more than one pair of adjacent layers such that the winding arrangement is essentially cylindrical.

According to another aspect, a method for producing a winding arrangement is proposed. An electric conductor is coiled up such that several layers of the electric conductor around an axis are formed in such a way that each cooling duct of a plurality of cooling ducts extends between a pair of adjacent layers of the coiled electric conductor in axial direction through the winding arrangement and in tangential direction not entirely around the axis. Furthermore, the electric conductor is coiled up in such a manner that the cooling ducts of the plurality of cooling ducts are distributed among more than one pair of adjacent layers such that the winding arrangement is essentially cylindrical.

In the following the invention is described on the basis of embodiments illustrated by the figures.

DESCRIPTION OF THE INVENTION

Figure 1A:
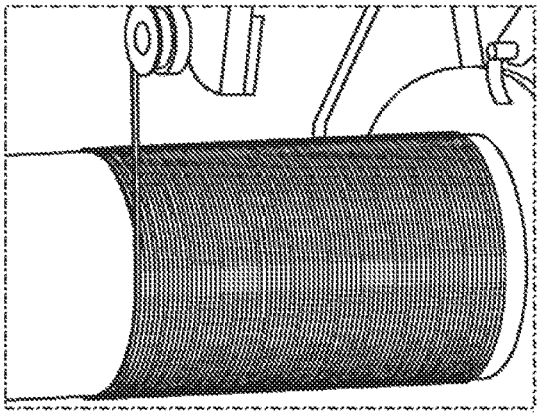
FIG 1A PRIOR ART
FIG. 1A shows wired winding arrangement according to the state of the art.
Figure 1B:
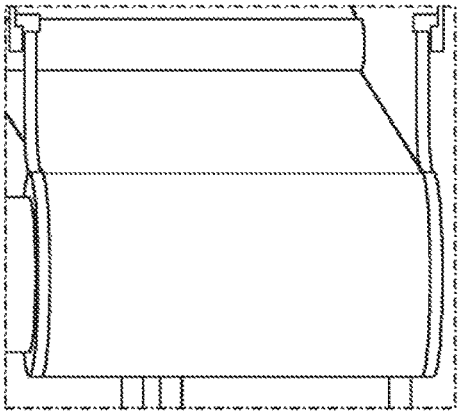
FIG 1B PRIOR ART
FIG. 1B shows a winding arrangement that is based on a coiled foil according to the state of the art.
Figure 2A:
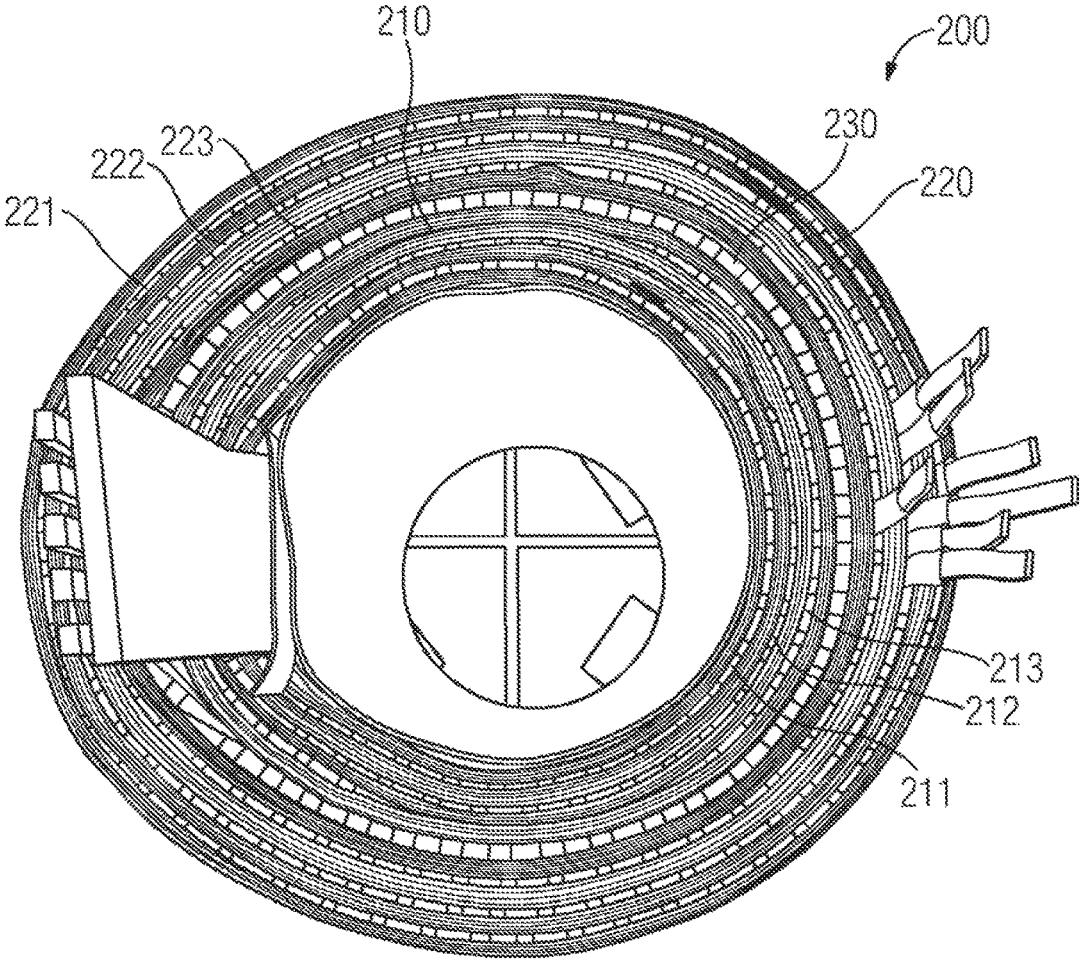
FIG 2A PRIOR ART
FIG. 2A shows a component for an electrical transformer according the state of the art.
Figure 2B:
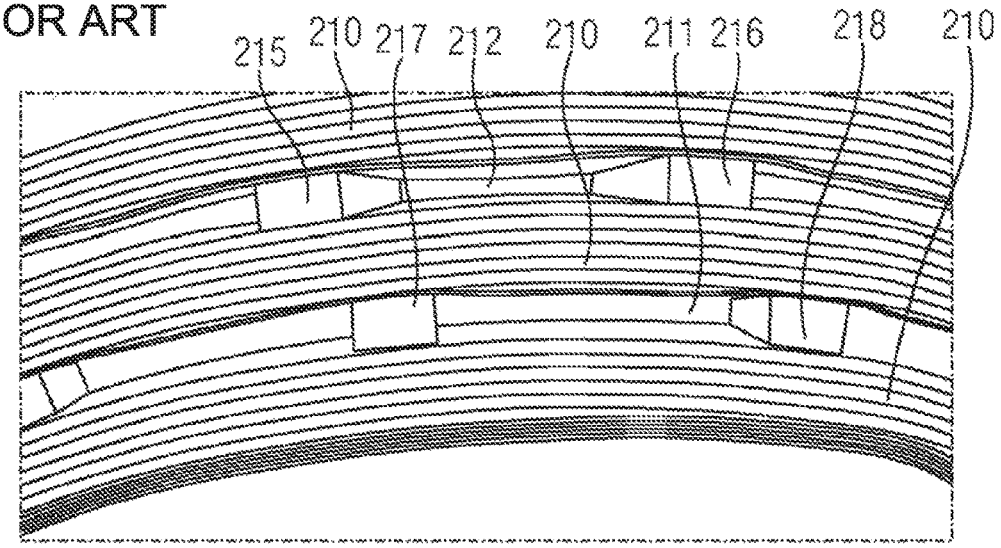
FIG 2B PRIOR ART
FIG. 2B which is an enlarged view of the inner winding of the component shown in FIG. 2A.
Figure 3:
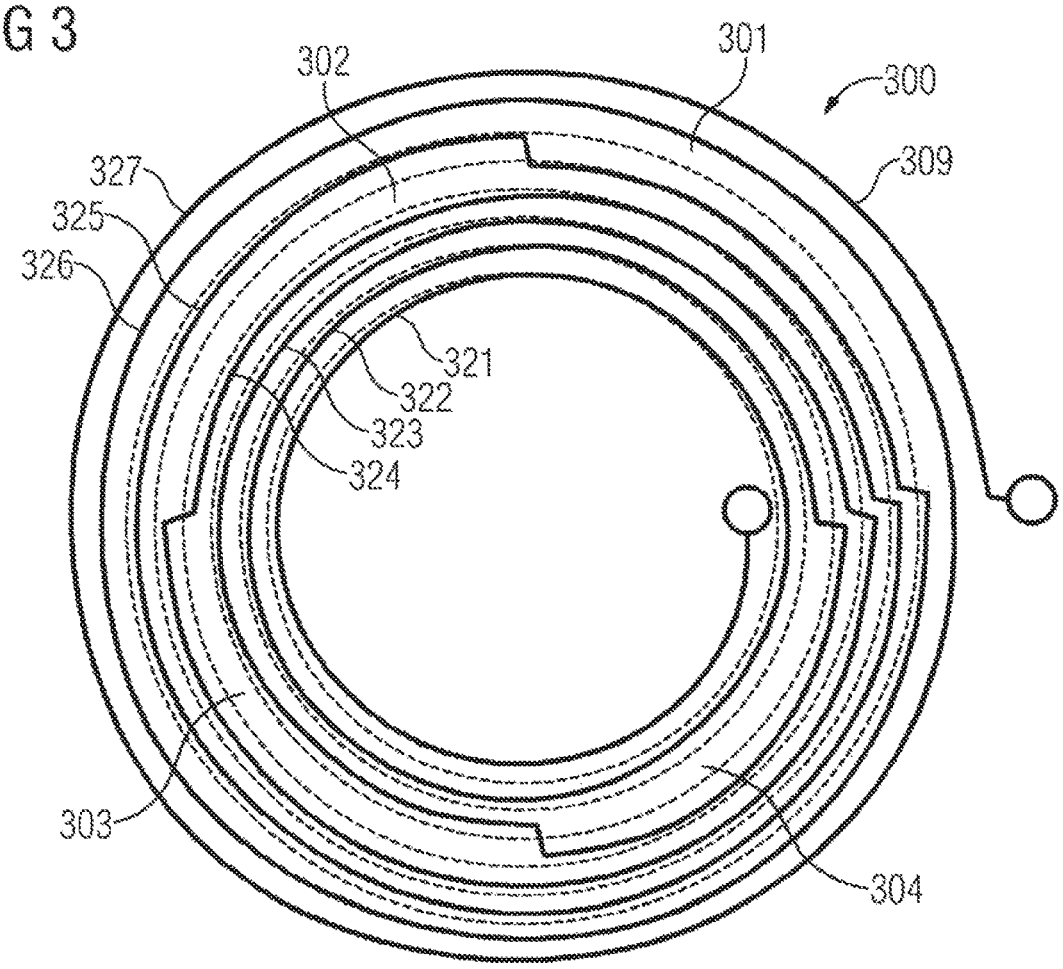
FIG. 3 shows a top view scheme of a winding arrangement according to an embodiment of the invention.

FIG. 3 shows a top view scheme of a winding arrangement 300 for an electric installation according to an embodiment of the invention. The winding arrangement 300 comprises an electric conductor 309 and a plurality of cooling ducts 301-304. The cooling ducts 301-304 are arranged within the winding arrangement 300. The electric conductor is coiled up forming seven layers 321-327 around an axis. Each cooling duct 301-304 extends between a pair of adjacent layers 322-326 of the coiled electric conductor 309 in axial direction through the winding arrangement 300 and in tangential direction not entirely around the axis 330. Adjacent in this context means, that no other layer of the electric conductor 309 is between the pair of adjacent layers. For example, in FIG. 3, the cooling duct 301 is located between the pair of adjacent layers 325, 326, and the cooling duct 302 is located between the adjacent layers 324, 325, etc. The plurality of cooling ducts 301-304 is distributed between more than one pair of adjacent layers 321-327 such that the winding arrangement 300 is essentially cylindrical.

Considering that the most inner cooling duct 321 can be cooled down from within the central cavity of the winding arrangement, and the most outer cooling duct 327 can be cooled down from the outside of the winding arrangement, only four cooling ducts are necessary to ensure that each of the exemplary seven layers 321-327 contacts directly a cooling means. The four cooling ducts 301-304 are arranged such within the winding arrangement that they can be considered to consist of four segments that are distributed between four different pairs of layers such that the four segments form a circumferential structure around the axis of the cylindrical winding arrangement that increases that diameter of the winding arrangement in a constant manner. Of course, the invention is not limited winding arrangements with four cooling ducts. The inventive concept can for example be applied to winding arrangements having two more cooling ducts. For example, each cooling duct 301-304 of said plurality of cooling ducts extends between a pair of adjacent layers 321-327 of the coiled electric conductor 309 in tangential direction maximally 180 degrees around the axis. This allows distributing two or more cooling duct in a simple regular manner between different pairs of layers, such that the plurality of cooling ducts form a circumferential structure around the axis that ensures a cylindrical form of the winding structure.

Also, it is not necessary that every interior layer 322-326 contacts a cooling duct. For example, also embodiments are possible where one or more layers contacts more than one cooling duct, or embodiments where not all interior layers contact a cooling duct. However, if each layer 321-327 of the coiled conductor 309 contacts at least one cooling duct 301-304, a particular efficient cooling is to be expected.

The electric conductor 309 is usually a foil or a wire. If the electric conductor 309 is a foil, usually each turn of the foil corresponds to a layer. If the electric conductor 309 is a wire, usually a plurality of turns forms a layer.

Figure 4A:
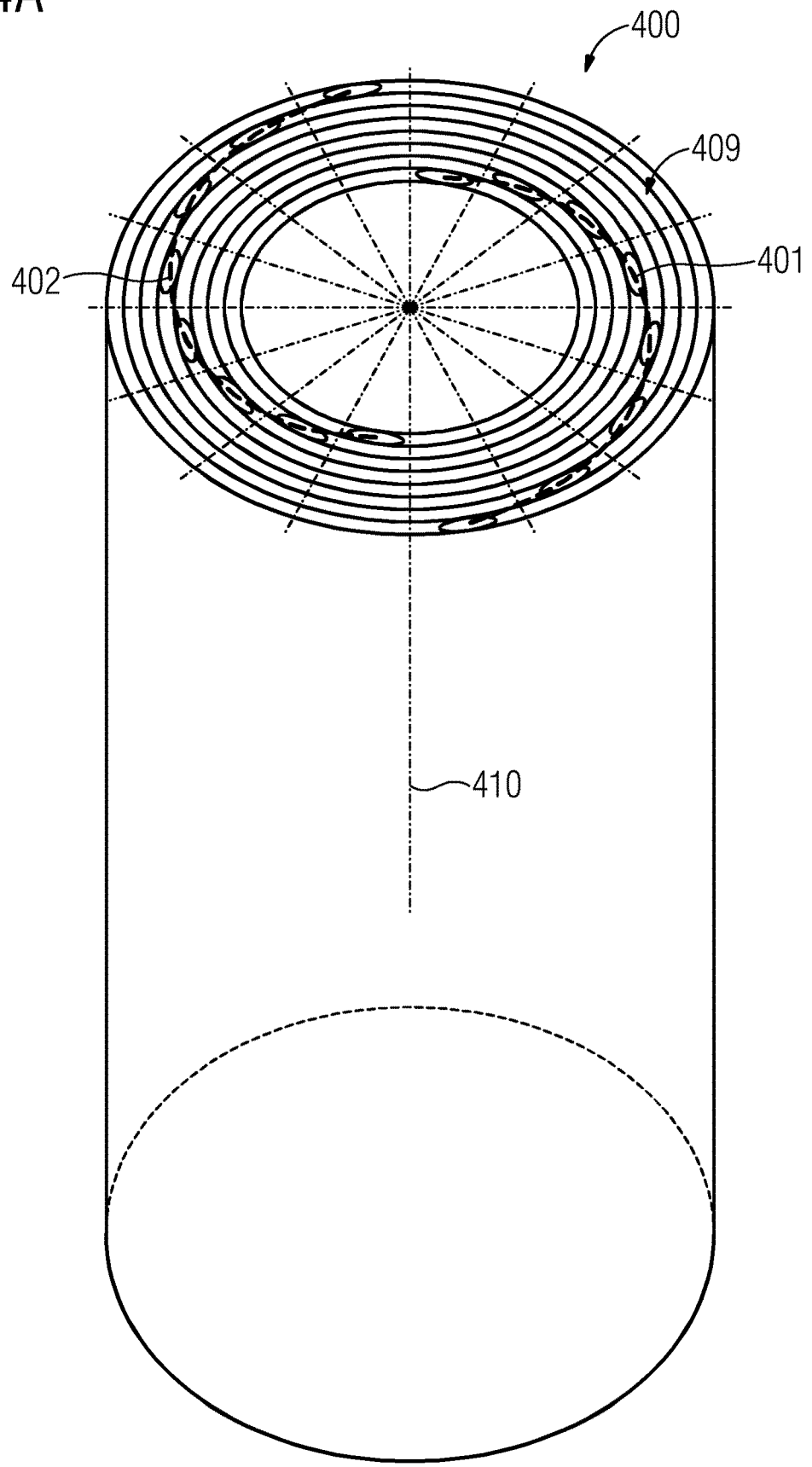
FIG. 4A shows a perspective view of a winding arrangement according to an embodiment of the invention.
Figure 4B:
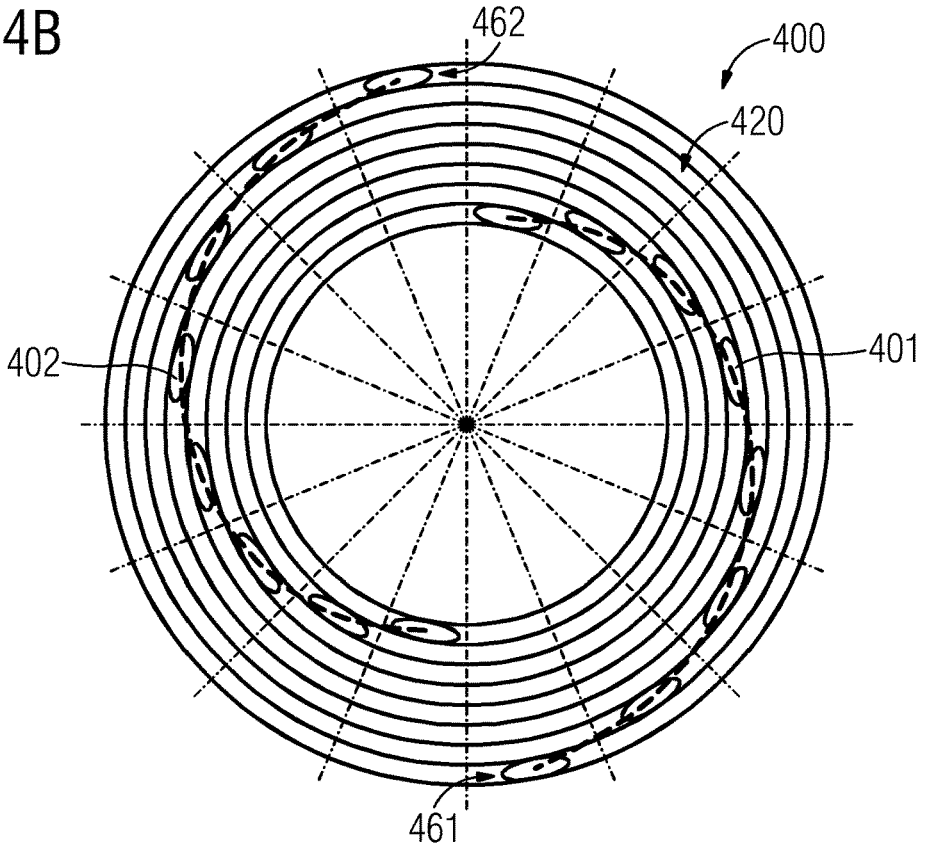
FIG. 4B shows a top view of the winding arrangement of FIG. 4A.

FIG. 4A shows a perspective view of a winding arrangement 400 according to an embodiment of the invention. FIG. 4B shows a top view schematic drawing of the winding arrangement 400. The winding arrangement 400 comprises an electrical conductor and two pluralities of cooling ducts 401, 402. The electrical conductor is coiled up in several layers 420. The cooling ducts 401, 402 are parallel to the axis 410 and arranged in two spiral arrangements 461, 462. Each layer of the winding arrangement contacts two cooling ducts.

Figure 5:
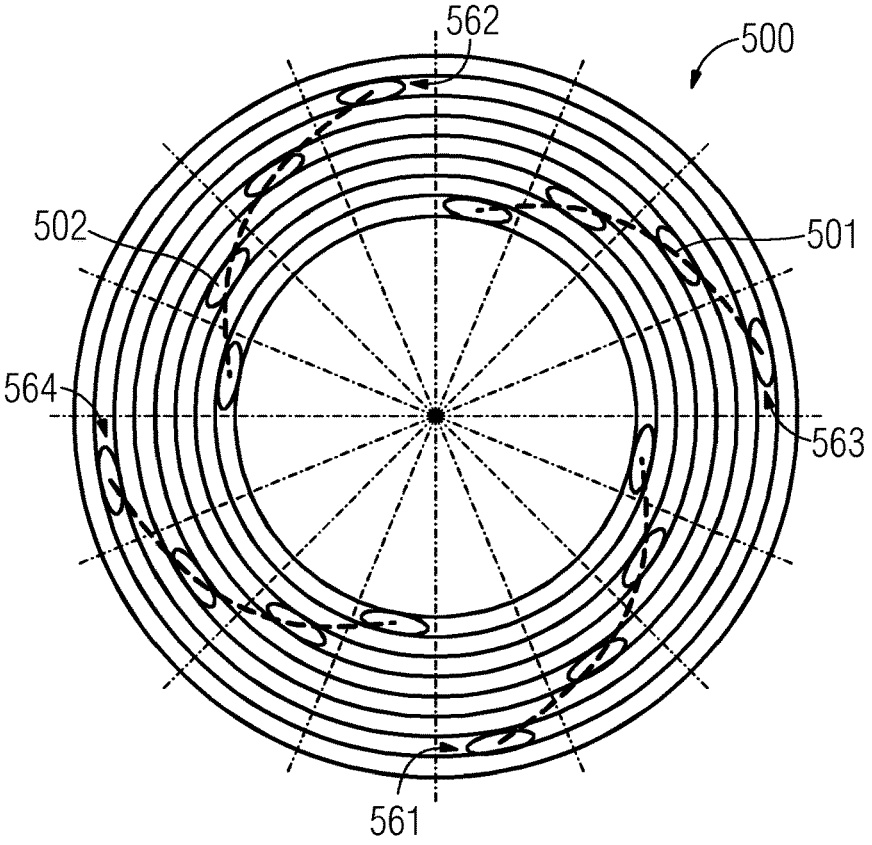
FIG. 5 shows a top view of a winding arrangement according to an embodiment of the invention.

FIG. 5 shows a top view of a winding arrangement 500 that is similar to the winding arrangement described in FIGS. 4A and 4B. However, instead of 2 spiral arrangements the winding arrangement of FIG. 5 comprises four spiral arrangements 561, 562, 563, 564 with cooling channels.

Figure 6A:
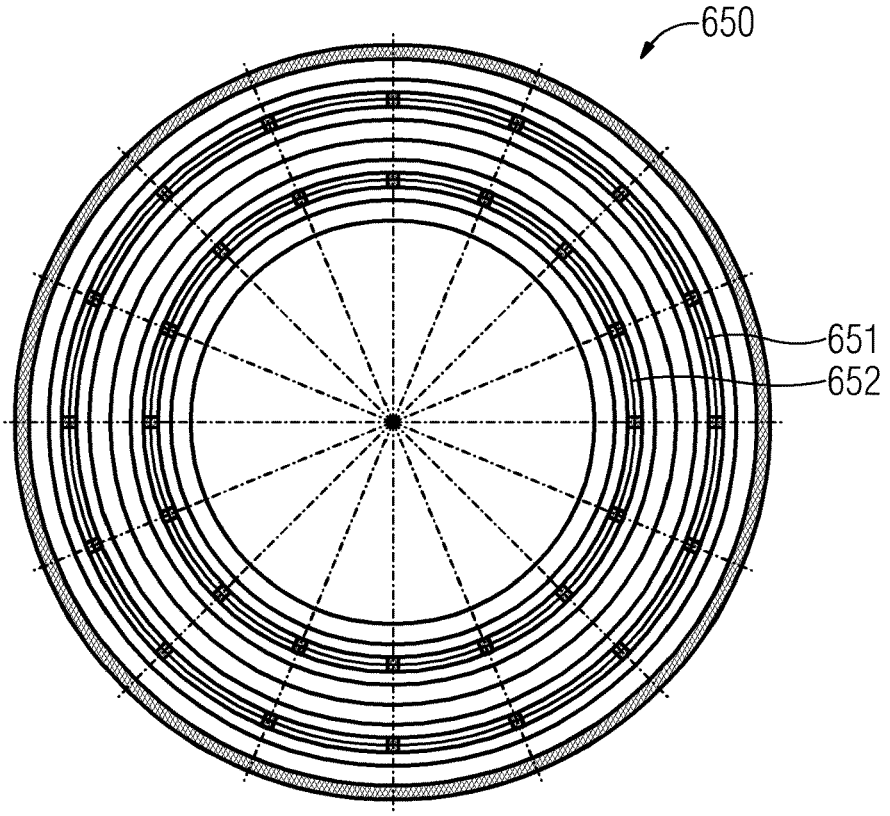
FIG. 6A shows a scheme of a top view of a winding arrangement for a transformer according to the state of the art.

FIG. 6A shows a top view schematic drawing of a winding arrangement 650 according to the state of the art. The winding arrangement 650 comprises two circumferential standard cooling channel arrangements. Two circumferential cooling ducts 651, 652 are each one entirely arranged between a pair of layers.

Figure 6B:
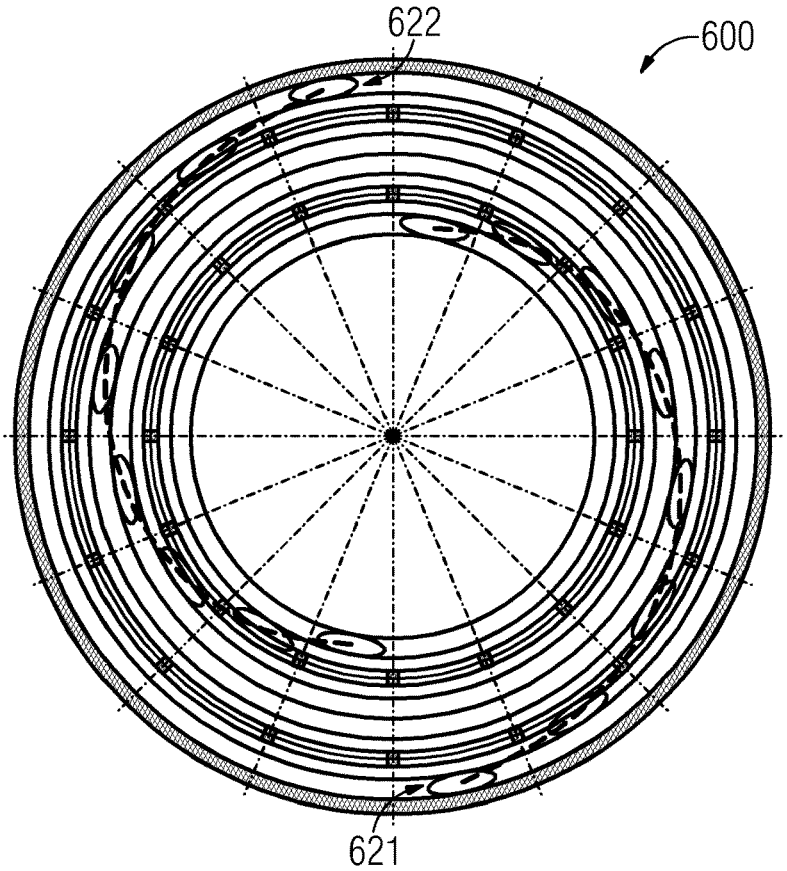
FIG. 6B shows a scheme of a top view of a winding arrangement according to an embodiment of the invention.

FIG. 6B shows a top view schematic drawing of a winding arrangement 600 according to an embodiment of the invention illustrating the differences to prior art standard cooling duct of FIG. 6A. In order to obtain sufficient cooling, the winding arrangement 600 distributes the cooling ducts over the entire winding arrangement along two spiral shapes 621, 622. FIGS. 6A and 6B are useful to illustrate the additional volume that is necessary to take into account for the two cooling channels 651, 652 of the winding arrangement 650. Supposed that the radial extension of a single cooling duct of the winding arrangement 650 is equal to the radial extension of one of the cooling ducts 651, 652, only half as much radial overall extension is necessary for providing cooling ducts for the winding arrangement 600 than for the winding arrangement 650.

Figure 7A:
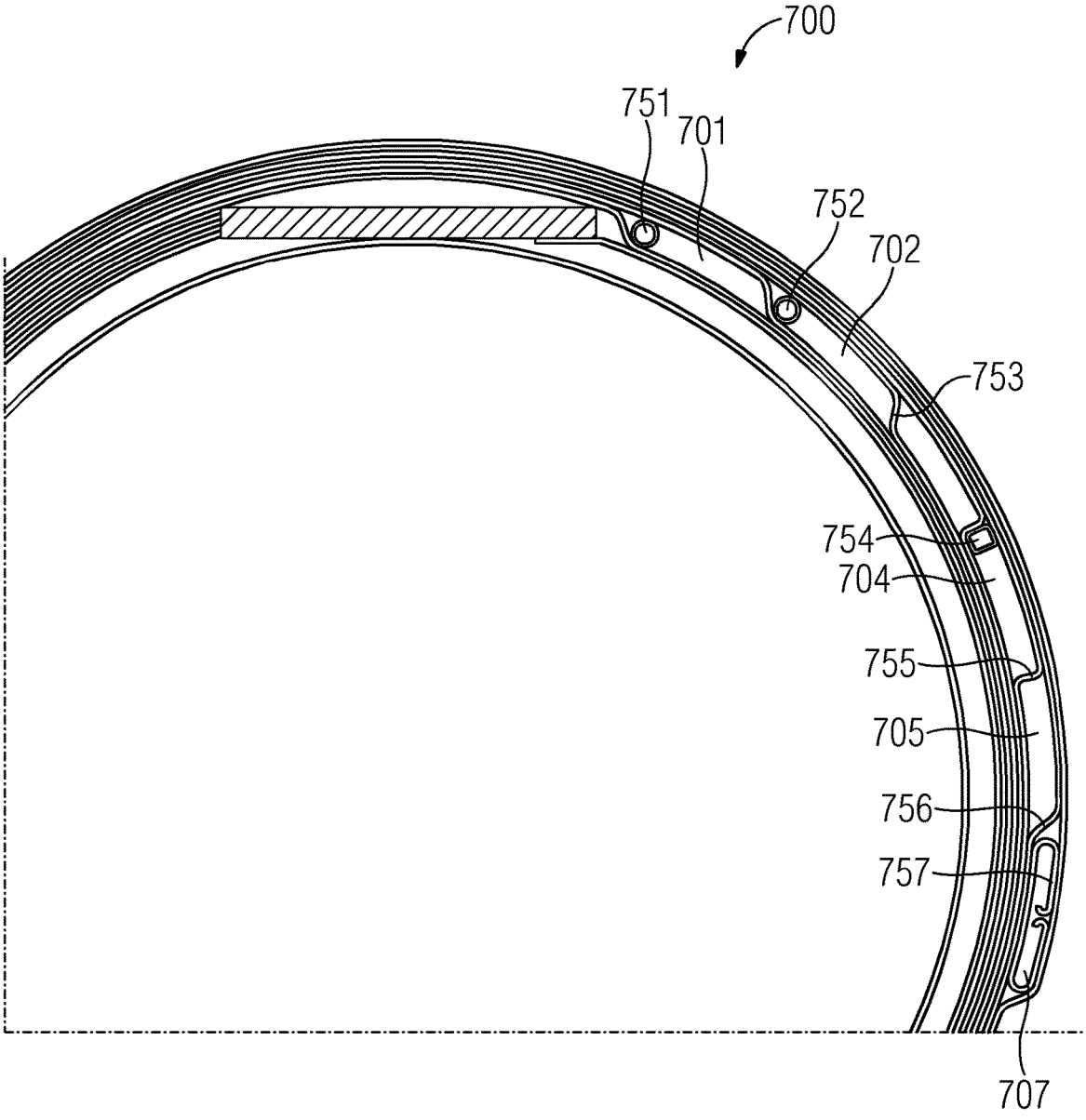
FIG. 7A shows a scheme of a winding arrangement with several types of shape and arrangement of cooling ducts illustrating several embodiments of the invention.
Figure 7B:
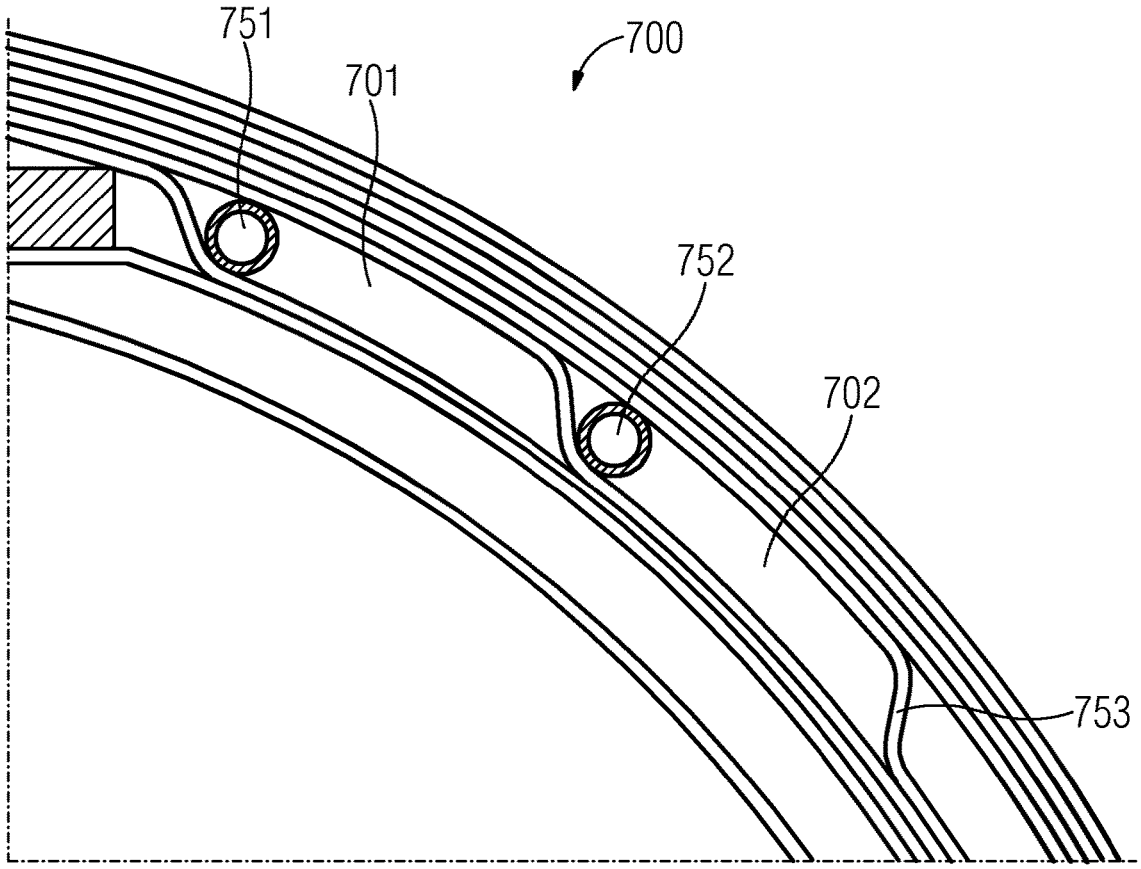
FIG. 7B is an enlarged view of the winding arrangement of FIG. 7A.

FIG. 7A shows a top view schematic drawing illustrating several types of shape and arrangement of the cooling ducts and strips. FIG. 7B is an enlarged view of a part of the winding arrangement 700 of FIG. 7A.

The winding arrangement 700 shows a simple cooling duct 701 formed by means of cylindrical strips 751, 752; a cooling duct 702 formed by means of a cylindrical strip 752, an insulation, and a bending 753; a cooling duct 704 formed by means of a rectangular strip 754, an insulation, and a bending 755; a cooling duct 705 formed by means of the almost rectangular bending 755, and a smooth bending 756; and a cooling duct 706 formed by means of an oval strip and an insulation. Of course, many other types of shapes and arrangements are possible for forming a cooling duct.

Figure 8A:
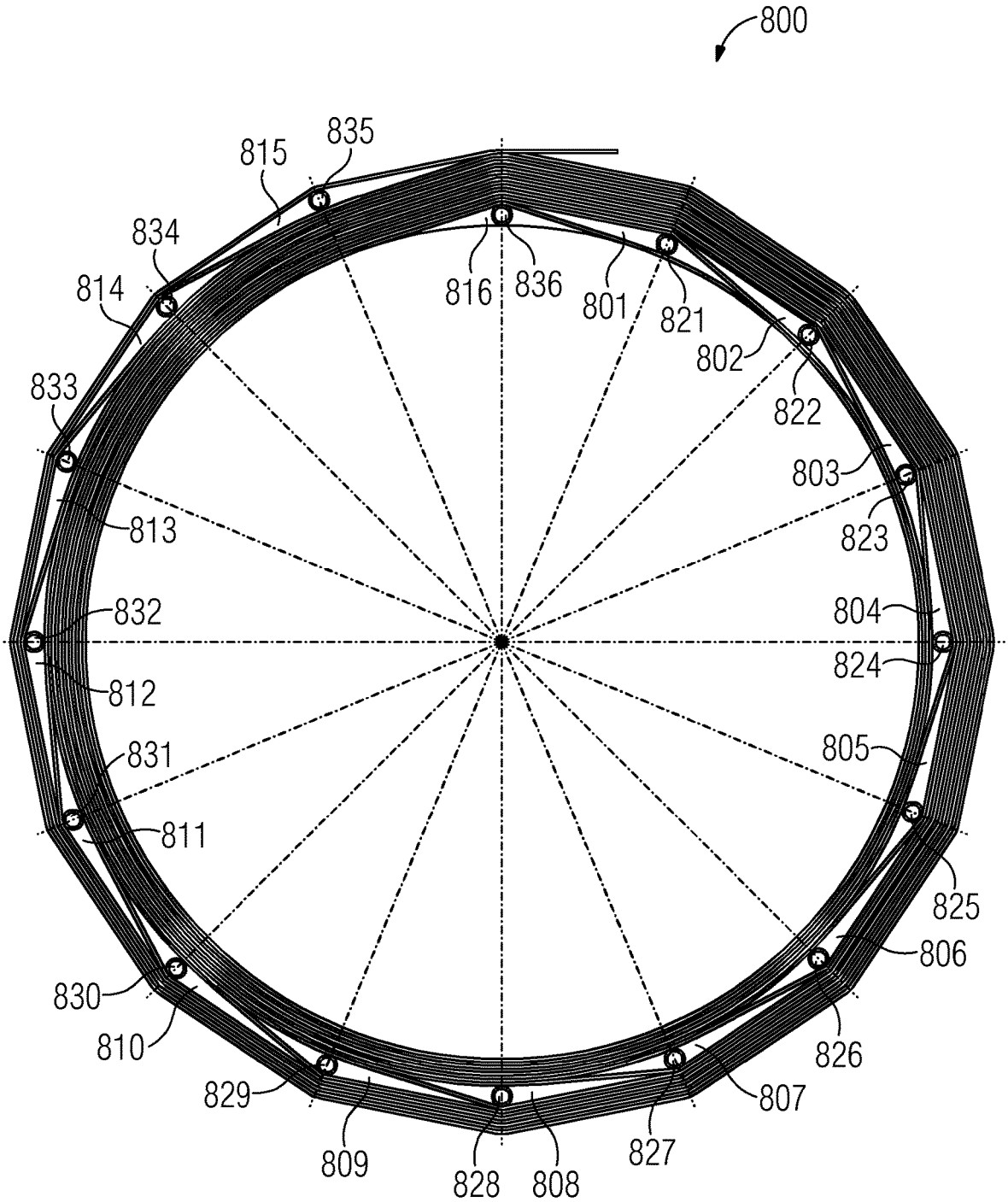
FIG. 8A is a scheme of a top view of a winding arrangement that was obtained by a direct winding process.
Figure 8B:
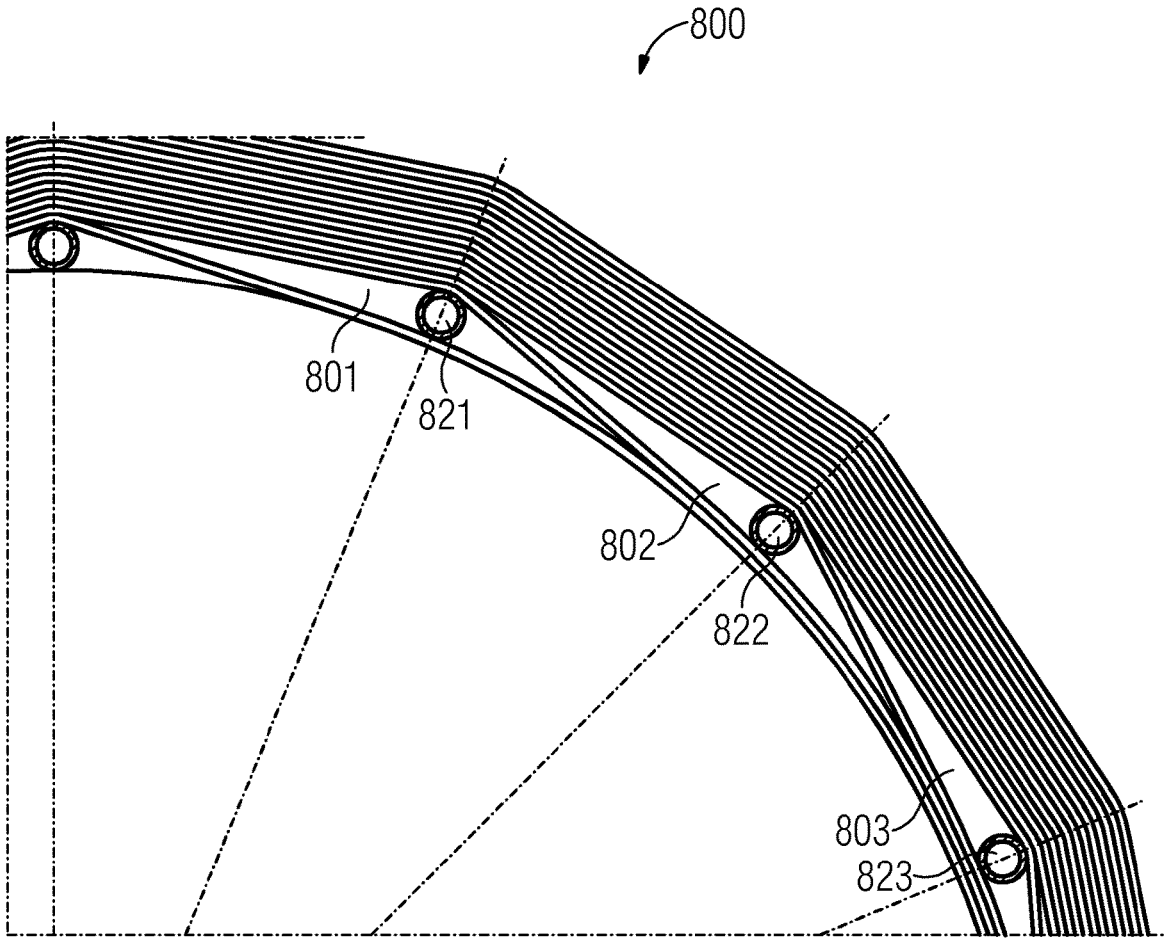
FIG. 8B is an enlarged view of the winding arrangement of FIG. 8A.

FIG. 8A shows a top view schematic drawing illustrating a winding arrangement 800 that was obtained by a direct winding process. FIG. 8B shows an enlarged view of a part of the winding arrangement 800. The winding arrangement comprises a plurality of cooling ducts 801, 802, 803, 804, 805, 806, 807, 808, 809, 810, 811, 812 extending in axial direction. Each cooling duct has a triangular shape and is formed by means of a strip 821, 822, 823, 824, 825, 826, 827, 828, 829, 830, 831, 832 above which at least one layer of the electrical conductor 899 is coiled, such that each strip spans a part of the electrical conductor 899 in order to form the respective cooling duct 801, 802, 803, 804. This allows for a particularly simple and efficient production process of the cooling ducts.

Figure 9:
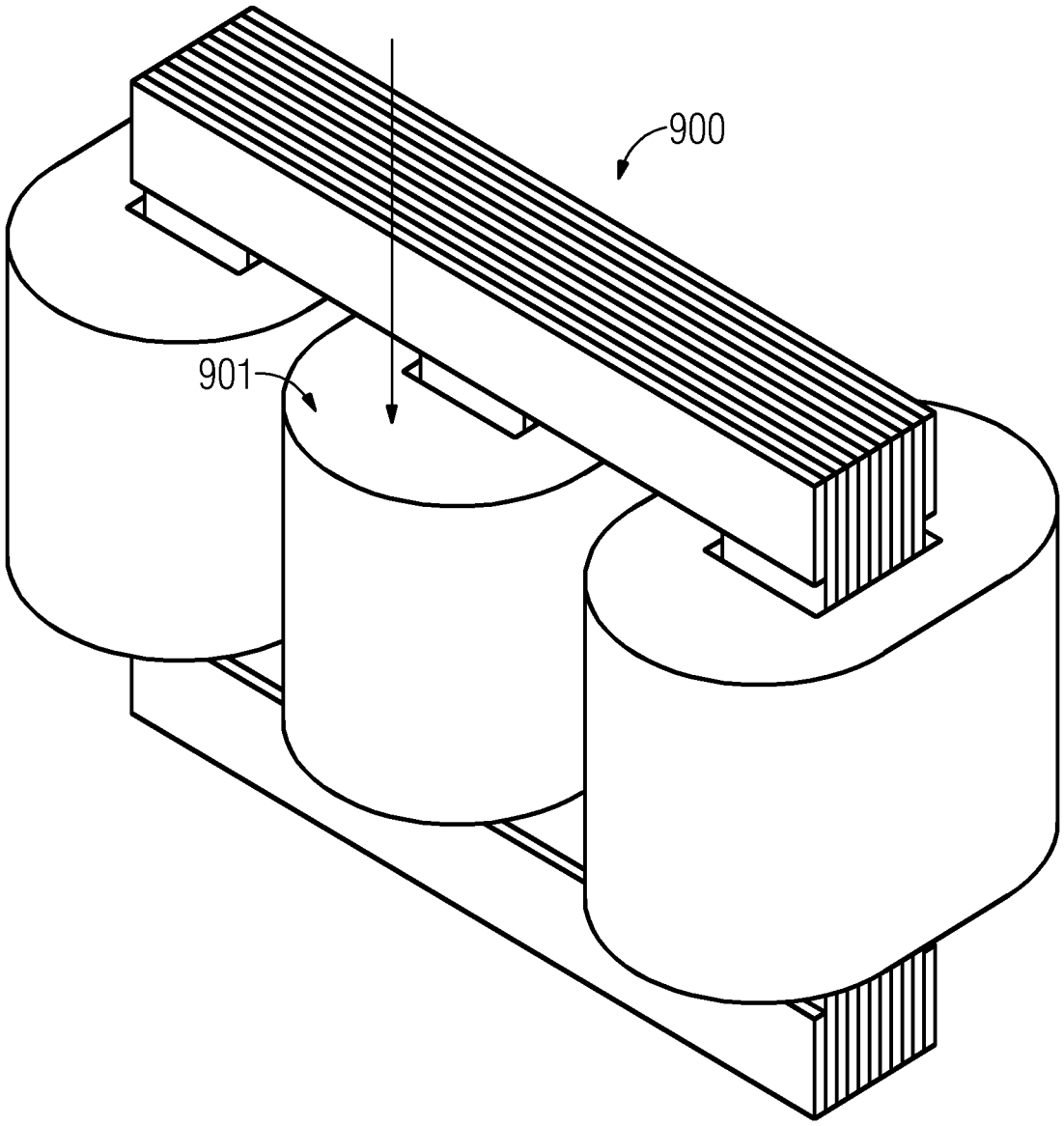
FIG. 9 is a perspective view of a three phase transformer comprising any of the previously described winding arrangements.

FIG. 9 shows an active part transformer 900 for illustrating a possible location 901 of winding arrangements according to an embodiment of the invention.

Embodiments of the invention allow obtaining a better winding compactness in order to decrease the quantity of conductor material and improve the cooling effect. As a further advantage, it becomes possible that for example the direct contact with each turn of the winding efficiently avoids hot zones on the concentrated zone where no cooling duct is present.

According to embodiments, the cooling ducts are created and stabilized by means of a strip. Such strips can be made from different shapes and materials. It is a purpose is to guarantee the consistency of the winding.

Further advantages and characteristics of embodiments involving a cooling duct for transformers' winding with split cooling ducts on a subsequent position, lies on the following concepts:

- To consider a transformer winding with at least one cooling channel that is crossed at least twice by the same turn.
- A (traditionally single) cooling duct is split up in up to N segments distributed amongst the (for example minimum 2N−1) turns, e.g. in a spiral arrangement from inside to outside.
- To introduce cooling ducts, as self-explained at figures, to uniform the cooling effect distribution and avoid the increase of radial dimension due to cooling channel.
- The cooling duct is arranged by a spiral along the winding;
- The cooling duct can be made by foil deforming by a mechanical process, such as stamping, rolling, or forging, or by the tension of winding machine
- The cooling duct can incorporate different kinds of strips, such as metal, PSP, and can combine different materials.
- The cooling ducts can have different widths.
- The cooling ducts can combine by Split Foil Winding.
- A winding arrangement according to an embodiment of the invention can comprise elements for deforming and create the Ducts that can be extracted after the winding process.
- In order to avoid larger dimensions it is desirable to optimize the number of cooling channels and even increase the conductor cross section and consequently the mass of it for required nominal conditions.
- In order to improve the cooling effect and at the same time avoid the increase of radial dimension, embodiments of the invention are based on a design that allows having a new distribution of cooling ducts along the spiral direction that likely uniforms the cooling effect on each turn and contributes to decrease the overall temperature.
- This cooling duct in subsequent positions for windings of the electric transformer (named cDuct) opens the possibility to save expenses by eliminating the additional space when it is necessary to use more than one complete cooling channel. This concept can be applied to most of winding types LV and HV windings. This will increase overall cooling effect using the same space occupied by a single cooling channel.

According to further embodiments winding arrangement can comprise metal strips as well as round, square, rectangular, and/or T-shaped strips.

According to further embodiments, the bending process can be performed as follows:

a) Start the winding process
b) Roll cross and deform the foil. Note that the bending process increases the length of the winding. However it is compensated by a decreasing of the outer radius of the winding arrangement.

According to further embodiments that do not necessarily require a bending process:

c) Winding process: put strip to deform and create the cooling duct
d) specify the next angle and include the next strip.
Alpha_i+1=360°/Step_i
Radial_i+1=Radical_i+Foil_thickness (+t_Insulation)
e) Strips aligned Diameter Symmetric.

The invention claimed is:

1. A winding arrangement for an electric installation, the winding arrangement comprising:

an electric conductor coiled up around an axis and forming a plurality of layers;

a plurality of cooling ducts, each one of said cooling ducts extending between a pair of mutually adjacent layers of said coiled electric conductor in an axial direction through the winding arrangement, and each one of said cooling ducts extending not entirely around the axis;

each layer of said electric conductor contacting at least one said cooling duct, said cooling ducts being disposed in a spiral arrangement from inside to outside for making a uniform cooling on each turn and such that said cooling ducts form a circumferential structure around the axis that increases a diameter of the winding arrangement in a constant manner and that therefore ensures that the winding arrangement is substantially cylindrical; and said cooling ducts of said plurality of cooling ducts being distributed between more than one pair of said adjacent layers to render the winding arrangement to be substantially cylindrical.

2. The winding arrangement according to claim 1, wherein each said cooling duct of said plurality of cooling ducts extends between a pair of adjacent layers of said coiled electric conductor maximally 180 degrees around the axis.

3. The winding arrangement according to claim 1, wherein said plurality of cooling ducts are arranged such that said plurality of cooling ducts reaches around the axis.

4. The winding arrangement according to claim 1, comprising two pluralities of cooling ducts, arranged in two spiral arrangements, and wherein each layer contacts two cooling ducts.

5. The winding arrangement according to claim 1, wherein said electric conductor is a foil or a wire.

6. The winding arrangement according to claim 1, wherein each said layer comprises one or a plurality of turns, and wherein said electric conductor is insulated so that each turn is insulated against adjacent turns.

7. The winding arrangement according to claim 1, further comprising strips reinforcing said cooling ducts.

8. The winding arrangement of claim 7, wherein said cooling ducts are formed by said strips, and said electrical conductor is spanned over said strips.

9. A method of producing the winding arrangement according to claim 1, the method comprising:

coiling up an electric conductor and thereby forming a plurality of layers of the electric conductor around an axis;

placing a plurality of cooling ducts such that each cooling duct extends between a pair of adjacent layers of the coiled electric conductor in an axial direction through the winding arrangement and extends not entirely around the axis; and thereby distributing the cooling ducts of the plurality of cooling ducts among more than one pair of adjacent layers such that the winding arrangement is substantially cylindrical;

wherein each layer of the electric conductor contacts at least one of the cooling ducts, the cooling ducts are disposed in a spiral arrangement from inside to outside for making a uniform cooling on each turn, and the cooling ducts form a circumferential structure around the axis that increases a diameter of the winding arrangement in a constant manner to therefore ensure that the winding arrangement is substantially cylindrical.

10. The method according to claim 9, which comprises reinforcing the cooling ducts by strips extending parallel to the axis.

11. The method according to claim 10, which comprises forming the cooling ducts from the strips and spanning the electrical conductor over the strips.

* * * * *